US006675391B2

(12) United States Patent
Morrison

(10) Patent No.: US 6,675,391 B2
(45) Date of Patent: Jan. 13, 2004

(54) WEIGHT VEST

(76) Inventor: George R. Morrison, 4506 Branchmead Ct., Katy, TX (US) 77450

( * ) Notice: Subject to any disclaimer, the term of this patent is extended or adjusted under 35 U.S.C. 154(b) by 0 days.

(21) Appl. No.: 10/156,434

(22) Filed: May 28, 2002

(65) Prior Publication Data

US 2002/0152534 A1 Oct. 24, 2002

(51) Int. Cl.[7] ..... A63B 21/065; A41H 1/02
(52) U.S. Cl. ..... 2/102; 482/105
(58) Field of Search ..... 2/102, 2.5, 69, 2/94, 456, 247; 482/105, 139

(56) References Cited

U.S. PATENT DOCUMENTS 3,116,491 A * 1/1964 Previdi et al. ..... 2/106
3,848,267 A * 11/1974 DeSpain ..... 2/94
4,344,620 A 8/1982 Debski
4,382,302 A 5/1983 Watson
4,394,012 A 7/1983 Egbert et al.
4,602,387 A 7/1986 Zakrzewski
4,637,075 A * 1/1987 Ingrisano et al. ..... 2/94
4,658,442 A 4/1987 Tomlinson et al.
5,002,270 A 3/1991 Shine
5,024,360 A 6/1991 Rodriguez
5,144,694 A * 9/1992 Conrad Da oud et al. ..... 2/69
5,146,625 A * 9/1992 Steele et al. ..... 2/102
5,398,340 A * 3/1995 Kibbee ..... 2/2.5
5,692,238 A * 12/1997 Watson, Jr. ..... 2/102
5,754,982 A * 5/1998 Gainer ..... 2/2.5
5,768,706 A 6/1998 Griffith et al.
5,789,327 A * 8/1998 Rousseau ..... 442/135
5,810,699 A 9/1998 Nadeau
5,943,700 A 8/1999 Hammer et al.
5,953,750 A * 9/1999 Stella ..... 2/2.15
6,189,149 B1 * 2/2001 Allen ..... 2/102
6,209,135 B1 * 4/2001 Irvin ..... 2/102
6,233,737 B1 * 5/2001 Ditchfield et al. ..... 2/2.5
6,286,146 B1 9/2001 Rocker

* cited by examiner

*Primary Examiner*—Tejash Patel
(74) *Attorney, Agent, or Firm*—Slater & Matsil, L.L.P.

(57) ABSTRACT

A weight vest (10) comprising a front portion (14) and a back portion (50). The front portion (14) is attachable to the back portion (50) in a shoulder region by a primary fastening system (24/66). The amount of surface area of the primary fastening system (24/66) may be varied to adjust to the torso length of the wearer. A secondary fastening system (26/68) may also used to attach the front portion (14) to the back portion (50). A plurality of weights (36) having a cylindrical shape may be placed within sub-pockets (34) of a superior pocket (16*a*) and an inferior pocket (16*b*) on the front portion (14) and back portion (50) of the weight vest (10). A belt (52) comprising a superior lateral strap (54*a*) and an inferior lateral strap (54*b*) is coupled to the back portion superior pocket and back portion inferior pocket, respectively. The belt (52) is adapted to hold the weight vest (10) closely to the wearer's torso.

40 Claims, 6 Drawing Sheets

WEIGHT VEST

TECHNICAL FIELD

This invention relates generally to athletic training gear and rehabilitation equipment, and more particularly to a weight vest.

BACKGROUND

To improve fitness and/or improve functional ability, many people work out by participating in aerobic activities and weight training, as examples. Many athletes use weights in order to tone and develop muscles. Weights used for weight training range from free weights, including a bench press and dumbbell weights, to weight training stations. Resistance-type weights have electronic displays and adjustments. Recent weight designs include deformable weight bands that can be worn about the ankles or wrists.

Professional athletes work out, often on a daily basis, and tend to utilize more exotic training equipment than the average exerciser. Weighted clothing such as weight vests have been designed for use in athletic training, for example, in plyometric or jump training, which comprises explosive strength training that is used to increase lower extremity strength and agility. Runners, downhill skiers, football players, and other athletes benefit from adding weights to the body above the waist during a workout. Wearing a weight vest intensifies the workout and challenges the athlete's performance.

Prior art weight clothing is not widely used because it is bulky and inconvenient to adorn or wear. Often the clothing includes weights that are loosely fitted to the wearer's torso, so that during movement, the weights move about and can cause bruising and injury to the wearer, and also throw the athlete off balance. In some weight vest designs, weights are improperly placed on the wearer's body, causing rubbing or chafing against the body, and restricting waist and upper body movement. In some designs, the weights easily fall off or slide out of retention devices.

SUMMARY OF THE INVENTION

Embodiments of the present invention achieve advantages as a weight vest in which weights are positioned within superior and inferior pockets on the front and back, close to the wearer's body. The position of the weights vertically with respect to the wearer's body is adjustable by a primary fastening system in a shoulder region of a front and back portion of the vest. A secondary fastening system may be used in addition to the primary fastening system to join the front and back portions of the vest. A belt having a superior lateral strap and an inferior lateral strap may be fastened to the back portion to accommodate a variety of torso girths, and is adapted to keep the weights inside the vest pockets pressed firmly against the wearer's torso. A plurality of cylindrical weights may be placed vertically within sub-pockets of the pockets. The number of weights used within the vest may be varied according to the athletic ability and condition of the wearer.

In one embodiment, a weight vest includes a first portion having two shoulder regions extending upwardly therefrom, and a second portion removeably attached to the first portion. The second portion has two shoulder regions extending upwardly therefrom, and the first and second portions are adjustably attached at the shoulder regions so that the length of the first and second portions along a torso can be varied.

At least one first pocket is disposed on the first portion, the first pocket being adapted to hold at least one weight. At least one second pocket is disposed on the second portion, the second pocket being adapted to hold at least one weight. A belt is coupled to the second portion and is adapted to extend around a wearer's torso and attach to the first portion, wherein the first and second portions may be adjusted according to a wearer's torso length at the shoulder region.

In another embodiment, a weight vest includes a front portion having two shoulder regions extending upwardly therefrom, and a back portion removeably attached to the front portion, the back portion having two shoulder regions extending upwardly therefrom. The back portion shoulder regions are longer than the front portion shoulder regions, and the front and back portions are attached at the shoulder regions. The weight vest includes a first fastening system coupled between the front and back portions between the shoulder regions, and a second fastening system disposed proximate the first fastening system adapted to couple the front and back portions together. A superior pocket is attached to the front portion proximate the shoulder regions, the superior pocket including a closeable flap. An inferior pocket is attached to the front portion disposed below the superior pocket, the inferior pocket including a closeable flap. A superior pocket is attached to the back portion proximate the shoulder regions, the superior pocket including a closeable flap. An inferior pocket is attached to the back portion disposed below the superior pocket, the inferior pocket including a closeable flap. A pocket closing device is coupled to the front and back portion superior and inferior pocket closeable flaps. A plurality of sub-pockets is disposed within the front and back portion superior and inferior pockets, each sub-pocket including a vertical chamber adapted to securely hold a cylindrical weight. A belt is coupled to the back portion adapted to extend around a wearer's torso and attach to the front portion by a belt fastener, the belt comprising a superior lateral strap and an inferior lateral strap disposed beneath the superior lateral strap, wherein the first and second portions may be adjusted according to a wearer's torso length at the shoulder region, wherein the belt holds the weight vest securely to a wearer's torso.

In another embodiment, a method of making a weight vest includes providing a front portion and a back portion, the front portion and back portion each having two shoulder regions extending upwardly therefrom, sewing a superior pocket proximate the shoulder region and an inferior pocket below the superior pocket on the front portion, and sewing a superior pocket proximate the shoulder region and an inferior pocket below the superior pocket on the back portion. The method includes forming a plurality of sub-pockets within the front and back superior and inferior pockets, each sub-pocket having a chamber adapted to retain a single cylindrical weight. The method includes coupling the front portion to the back portion by a first fastening system at the shoulder region and by a second fastening system proximate the first fastening system, and coupling a belt to the back portion.

Another embodiment of the invention includes an athletic training vest, including a first portion having two shoulder regions extending upwardly therefrom, a second portion removeably attached to the first portion and having two shoulder regions extending upwardly therefrom. The first and second portions are adjustably attached at the shoulder regions so that the length of the first and second portions along a torso can be varied. At least one D-ring is coupled to at least one of the first and second portions, wherein the D-ring may be used to attach the vest to another person or object, for added resistance, over-speed training, and multiple plane resistance. A belt is coupled to the second portion adapted to extend around a wearer's torso and attach to the first portion, wherein the first and second portions may be adjusted according to a wearer's torso length at the shoulder region.

Advantages of embodiments of the present invention include a weight vest that is adjustable at the shoulder to accommodate various heights and torso lengths of people. The weights are cylindrical with tapered ends, and are positioned in the sub-pockets vertically, which prevents injury to the ribs in case of a fall. The weight vest may have a primary and secondary fastening system at the shoulder for connecting the first portion to the second portion, which is advantageous if either one of the primary or secondary fastening system is faulty. In one embodiment, the weights may be covered in rubber or painted to prevent corrosion, which is advantageous if the weight vest is used in aquatic training. The weight vest is easy to put on and may be easily adjusted to securely fit against the torso of the wearer.

BRIEF DESCRIPTION OF THE DRAWINGS

The above features of embodiments of the present invention will be more clearly understood from consideration of the following descriptions in connection with accompanying drawings in which.

Corresponding numerals and symbols in the different figures refer to corresponding parts unless otherwise indicated. The figures are drawn to clearly illustrate the relevant aspects of the preferred embodiments and are not necessarily drawn to scale.

DETAILED DESCRIPTION OF PREFERRED EMBODIMENTS

Preferred embodiments of the present invention will be discussed, followed by a discussion of some advantages thereof.

Figure 1:
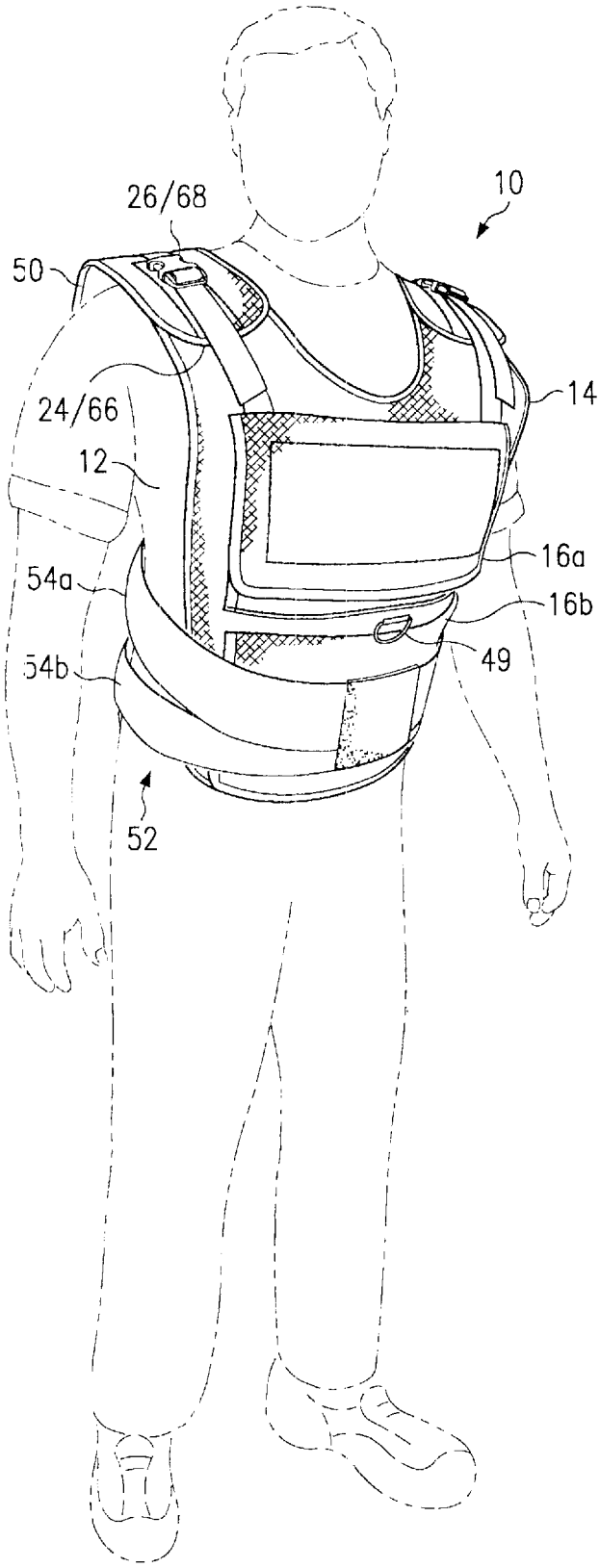
FIG. 1 shows a person wearing an embodiment of the weight vest in accordance with the present invention.

FIG. 1 illustrates the weight vest 10 in accordance with an embodiment of the present invention being worn by a person. The weight vest 10 is adapted to fit snuggly and securely to the wearer's torso 12, as shown, so that the weights remain fixed against the body when the person moves about. The weight vest 10 includes a first portion 14, also referred to herein as the front portion. The front portion 14 is removeably and adjustably attached in a shoulder region to a second portion 50, also referred to herein as a back portion. Advantageously, the front portion 14 and back portion 50 may be moved with respect to one another before fastening to accommodate various torso lengths. The front portion 14 is attached to the back portion 50 in the shoulder region by a first fastening system 24/66 and preferably, also by a second fastening system 26/68. The first fastening system 24/66 is also referred to herein as a primary fastening system, and the second fastening system 26/68 is also referred herein as a secondary fastening system.

The front and back portions 14/50 of the weight vest 10 include at least one pocket 16 adapted to hold a plurality of weights. Preferably, the front and back portions 14/50 comprise two pockets 16 adapted to hold a plurality of weights against the wearer's body. A superior pocket **16*a* is disposed above an inferior pocket 16*b*, as shown. An optional D-ring 49 may be disposed in one or more regions of the weight vest 10, for example, preferably in a central region, and more preferably between the superior and inferior pockets 16*a*/16*b*,** as shown.

A belt 52 is attached to and extends from the back portion 50 around the wearer's sides and is attached to the inferior pocket **16*b* on the front portion 14. The belt 52 preferably comprises a superior lateral strap 54*a* and an inferior lateral strap 54*b*. The superior lateral strap 54*a* and an inferior lateral strap 54*b* are preferably comprised of elastic and are adapted to securely hold the weight vest 10 against the wearer's body during movement. Alternatively, the belt may comprise other materials, such as cotton, rubber, leather, plastic, or nylon, as examples. Because the belt 52 is attached to the back portion 50, the belt 52** essentially comprises quad lateral straps, two on each side of the wearer's torso.

Figure 2:
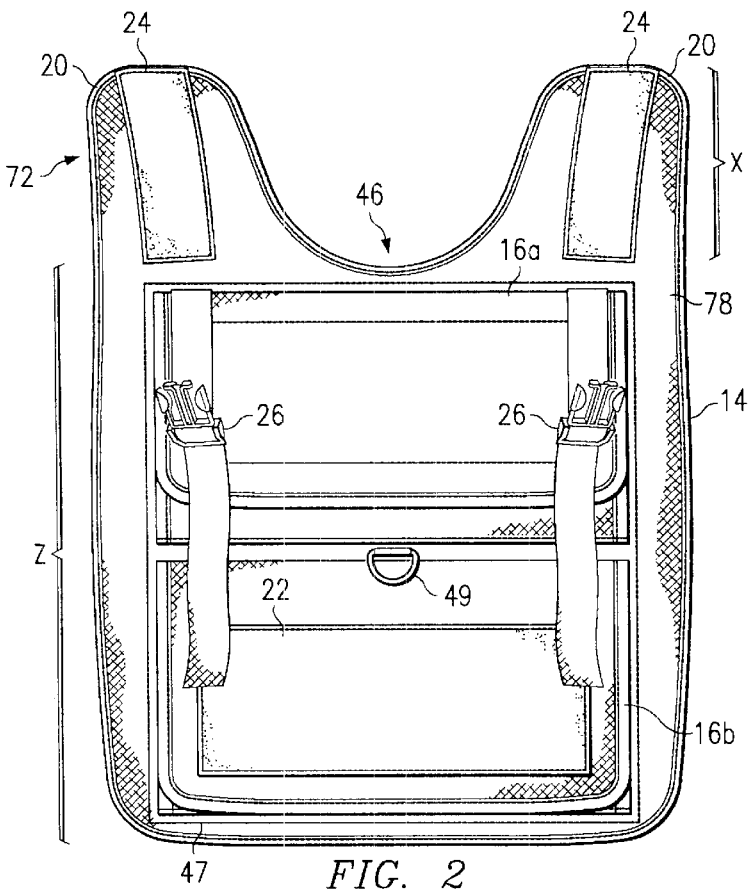
FIG. 2 illustrates a front portion of the weight vest.

FIG. 2 shows a front view of an embodiment of the front portion 14 of the weight vest 10. The front portion 14 preferably comprises an exterior material 78 that faces away from a wearer's body. The exterior material 78 preferably comprises a polymer fiber material such as nylon, for example, although the exterior material 78 may alternatively comprise other materials. The exterior material 78 may be treated with a non-permeable and anti-microbial/anti-bacterial coating to avoid moisture absorption and prevent odor from perspiration.

The front portion 14 also preferably comprises an inner liner material 76, also referred to herein as an inside liner (not shown in FIG. 2). The inner liner material 76 preferably comprises an absorbent, moisture-wicking, anti-microbial, anti-bacterial material such as orthopedic beta material, although alternatively, the inner liner material 76 may comprise other materials, for example. The exterior material 78 and inside liner 76 are stitched together to form the front portion 14. The materials used for both the exterior material 78 and inside liner 76 are preferably flexible and lightweight, are comfortable to the wearer and conformal to the wearer's body.

In one embodiment, the first or front portion 14 includes a support liner 47 disposed between the exterior material 78 and interior liner proximate the at least one weight pocket 16. The support liner 47 preferably comprises polypropylene, and may alternatively comprise other materials, such as cotton or nylon, as examples. More preferably, the support liner 47 comprises 1/16" polypropylene disposed only behind the pockets **16*a*/16*b*, for example. The support liner 47 is adapted to protect the wearer's body from injury, for example, during a fall taken while wearing the weight vest 10**.

The front portion 14 includes a shoulder region 20 disposed about either side of a neck region 46. The front or first portion 14 preferably includes a superior pocket 16*a* attached proximate the shoulder region, and an inferior pocket 16*b* disposed below the superior pocket 16*a*, as shown. The pockets 16*a* and 16*b* have closeable flaps (not shown in FIG. 2) that are adapted to be opened and closed. The pockets 16*a* and 16*b* include a plurality of sub-pockets (also not shown in FIG. 2; see FIG. 3), to be described further herein, that are adapted to securely hold a plurality of cylindrical weights.

A first fastening system 24 for fastening the first portion 14 to the vest second portion 50 is coupled to the shoulder region 20 of the front portion 14 on each side. Preferably, the first fastening system 24 comprises one side of a loop and hook fastener, although alternatively, the first fastening system 24 may comprise one side of other fastening systems, such as a zipper, buckle, quick-release clasp, snap, or button, as examples (not shown).

The front portion shoulder region 20 comprises a length x that may be, as an example, six inches. Alternatively, the front portion shoulder region length x may comprise 3 to 9 inches, as examples. In one embodiment, the shoulder region 20 may be provided with padding 72 disposed between the exterior material 78 and the inside liner 76, for example, to improve the comfort of the wearer. The padding 72 may comprise cotton, polyester, or other materials, as examples.

A second fastening system 26 for fastening the first portion 14 to the vest second portion 50 is preferably attached to the first portion 14 above the superior pocket 16*a*, proximate the first fastening system 24 in the shoulder regions 20. Preferably, the second fastening system 26 comprises one side of a clasp and strap, wherein the strap is adjustable to accommodate a variety of torso lengths. The clasps are preferably quick-release clasps, for example, although other clasps and buckles may be used. Alternatively, the second fastening system 26 may comprise other fasteners, such as a hook and loop fastener, a zipper, snap, or button, as examples.

The first portion 14 comprises a length z that extends along the torso of the wearer. Length z is preferably approximately 15 inches, although alternatively, the length z may comprise other distances, ranging from 12 to 22 inches, as an example. The adjustable first and second fastening systems 24/26 and length z are preferably designed so that the bottom edge of the weight vest front and back portions 14/50 will not rub on a wearer's greater trochanter, ischium, iliac crest, iliac spine, or other body parts, as examples, during use, when the weight vest is properly adjusted for the wearer. The width of the first portion 14 may comprise about fifteen inches, as an example, although the width may alternatively range from 12 to 20 inches, as an example. An optional belt fastener 22 may be attached to the inferior pocket 16*b* closeable flap, as shown, to be described further herein.

Either one or both of the front or back portion 14/50 may include an optional D-ring 49 preferably attached in a central region, for example, and more preferably disposed between the superior and inferior pockets 16*a*/16*b*, as shown. The D-ring 49 is preferably stitched to the front portion 14 using a short piece of strap material (not shown in FIG. 2), for example. The D-ring 49 may be used to provide physical connection to a trainer or another athlete. For example, a rope or strap may be clipped between the wearer to another person (for example, also wearing an embodiment of the present weight vest) for added resistance, over-speed training, and multiple plane resistance, as examples. Preferably, the D-ring strap is stitched to the front portion 14 in two or more places on the strap, to ensure that the D-ring 49 will not break free during a workout.

Figure 3:
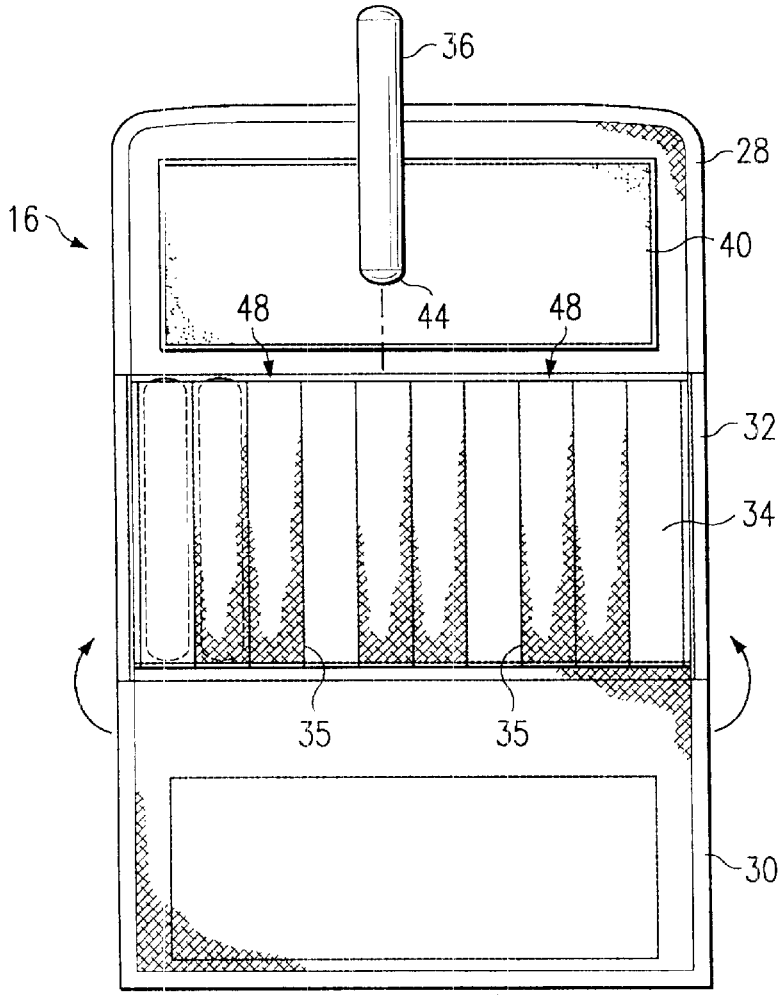

FIG. 3 shows a pocket 16 in accordance with a preferred embodiment of the invention. Preferably, the same pocket 16 design is used for all four pockets 16*a*/16*b*/16*c*/16*d* of the weight vest 10, which include the front portion superior and inferior pockets, and the back portion superior and inferior pockets. The pocket 16 includes a pocket flap 28 having a pocket closing mechanism 40 disposed thereon. For example, the pocket closing mechanism 40 may comprise one side of a hook and loop fastener sewn to the inside of the pocket flap 28. Alternatively, the pocket closing mechanism 40 may comprise a zipper, buckle, quick-release clasp, snap, or button, as examples (not shown).

The pocket 16 also comprises a pocket inner portion 32 having a plurality of sub-pockets 34 attached thereto. Each sub-pocket 34 includes a chamber 48 adapted to securely hold a cylindrically shaped weight 36. The sub-pockets 34 are substantially the size of a cylindrical weight 36. Each sub-pocket 34 comprises an individual pocket for a weight 36 and is adapted to hold weights 36 proximate one another, e.g., vertically and side-by-side. The sub-pockets 34 position the cylindrical weights 36 vertically against the wearer's body.

The cylindrical weights 36 preferably comprise at least one tapered end 44 and preferably comprise a uniform weight and shape. Weights 36 preferably weigh approximately one pound each, as an example. Alternatively, the cylindrical weights 36 may comprise other weights such as one-half pound to two pounds, as examples. The weights 36 are adapted to easily slide in and out of the sub-pockets 34 and are prevented from falling off of the vest, e.g., during inversion of the wearer, by a closeable flap 28.

The cylindrical shape of the weights 36 provides less surface area of the weight 36 against the wearer's body, which is an advantage. Also, the vertical positioning of the weights 36 helps prevent the ribs from being separated or broken, in case of a fall or blow, which may occur if elongated weights 36 are placed horizontally against the ribs. The weights 36 may comprise a material such as cast iron, although steel shot may alternatively be used, as an example. The weights 36 may be painted with a non-corrosive material such as an anodizing solution and/or may be encapsulated in rubber, to prevent corrosion, for example.

As an athlete becomes more conditioned, the weight of the weight vest 10 may be increased by sliding additional weights 36 into the sub-pockets 34, for example. In one embodiment, each pocket 16 preferably includes exactly ten sub-pockets 34, so that ten one-pound weights 36 can be placed in each pocket 16. In this embodiment, the weight vest 10 weighs a total of about forty pounds (plus the weight of the various materials used: for example, the exterior material 78, inner liner, shoulder padding 72/74 and support liner 47/84) when all of the weights 36 are inserted into the sub-pockets 34.

Figure 5:
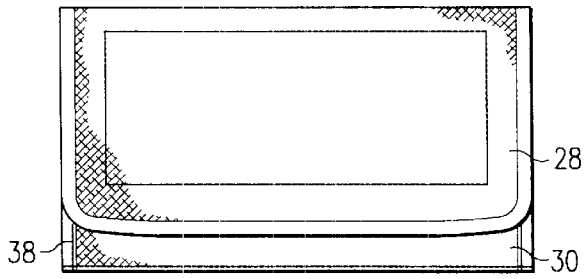
FIGS. 3–5 show a pocket having a plurality of sub-pockets for securely holding one or more cylindrical weights.
Figure 4:
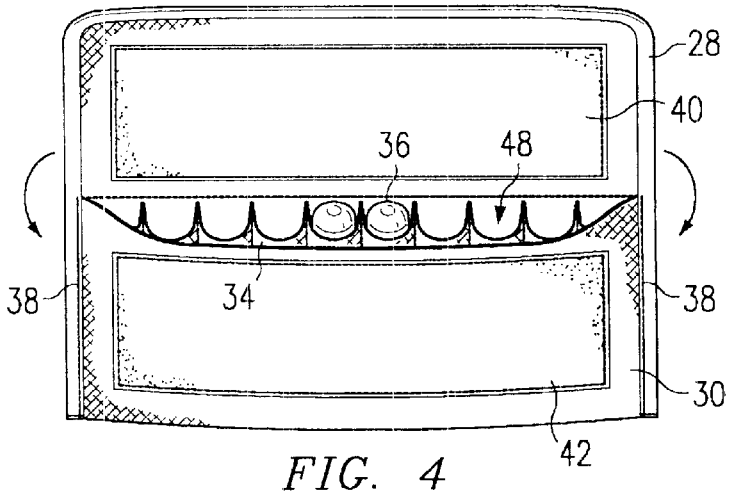

The pocket 16 also includes a pocket front 30, also referred to herein as a restricting barrier. The pocket front 30 is folded upwardly towards the pocket inner portion 32 and stitched at the edges 38 thereof, as shown in FIG. 4. Folding the pocket front 30 prevents the weights 36 from sliding out of the sub-pocket chambers 48. The pocket front 30 is pliable and may be pulled open to access the sub-pockets 34 when installing and removing the weights 36. The pocket 16 is closed by folding down the pocket flap 28, as shown in FIG. 5. A pocket closing mechanism 42 adapted to mate with pocket closing mechanism 40 in order to close the pocket 16 is preferably attached to the pocket front 30, as shown.

Preferably, the pocket flap 28, pocket inner portion 32, and pocket front 30 are comprised of a single piece of a material that is the same material used for the vest exterior material 78, such as nylon, for example, although alternatively, other materials may be used. The sub-pockets 34 preferably comprise a single piece of material, also preferably the same material used for the vest exterior 78, that is vertically stitched at 35 (FIG. 3), for example, leaving a loose fold of material to form the chamber 48 for each sub-pocket between the stitching 35.

Figure 6:
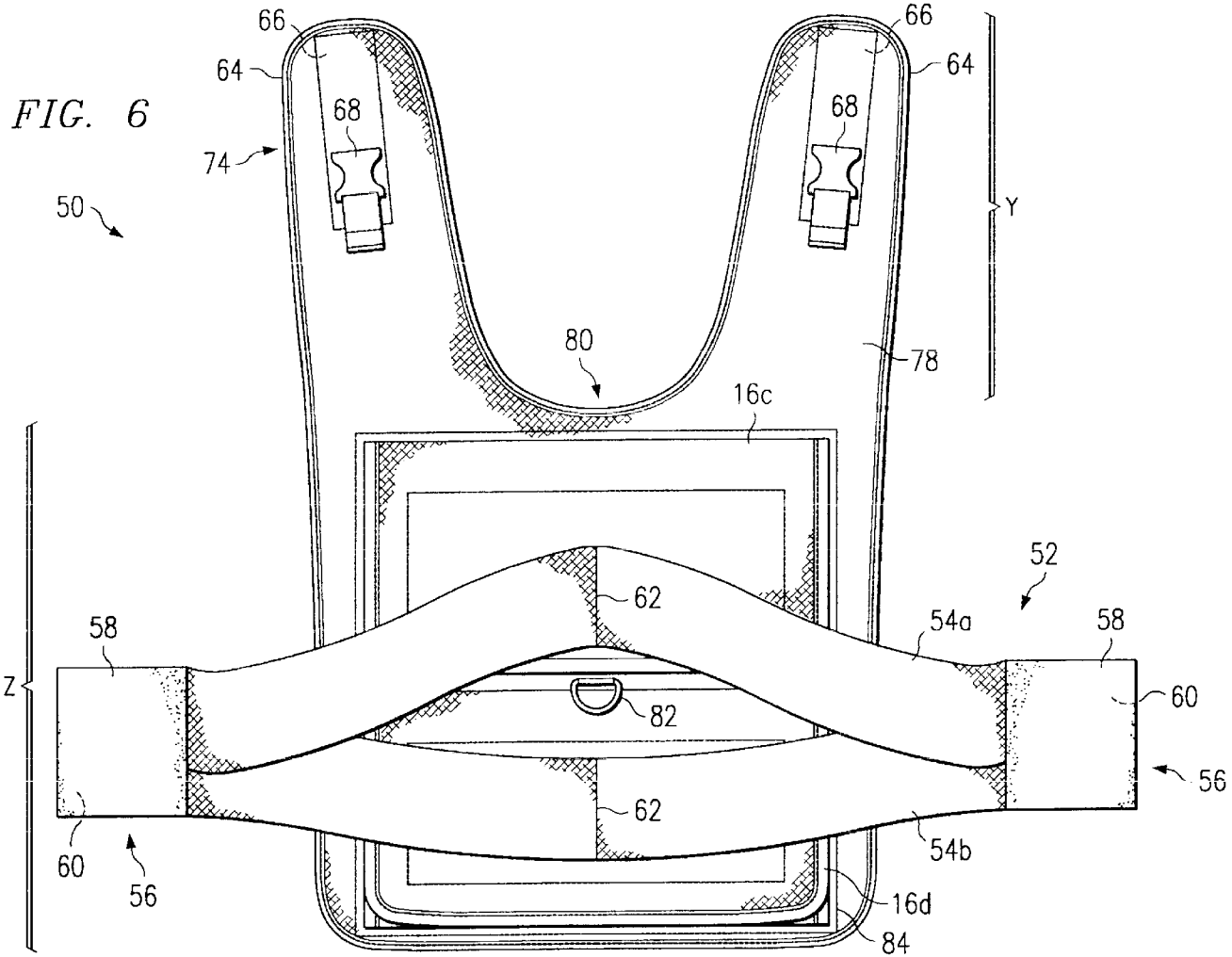
FIG. 6 shows a back portion of the weight vest having a longer shoulder region than the shoulder region of the front portion.

FIG. 6 shows an embodiment of the back portion 50 of the weight vest 10. The back portion 50 comprises a length z along the torso that is preferably substantially equal in length to dimension z of the front portion 14. Advantageously, the back portion 50 has shoulder regions 64 disposed on either side of a neck region 80, wherein the shoulder regions 64 preferably comprise a length y that is substantially longer than distance x of the front portion 14. For example, length y may comprise ten inches, which is four inches longer than distance x of the front portion 14. Alternatively, length y may be approximately equal to length x of the front portion 14.

The weight vest 10 is adjustable for a variety of torso sizes by moving the first portion 14 with respect to the second portion 50 prior to attaching the first and second portions 14/50 together. Because, in one embodiment of the present invention, the shoulder region 64 of the back portion is longer than the shoulder region x of the front portion 14, the weight vest 10 is more easily adjusted to accommodate the height and size of the torso of the person that is wearing the vest 10. The shoulder region 64 includes a first fastening system 66 preferably disposed on the underside of the back portion 50 on either side, as shown. First fastening system 66 is designed to mate with first fastening system 24. The first fastening system 66 preferably comprises one side of a hook and loop fastener, for example. Alternatively, first fastening system 66 may comprise one side of other fastening systems, such as a zipper, buckle, quick-release clasp, snap, or button, as examples (not shown).

The shoulder region 64 also preferably includes a second fastening system 68. The second fastening system 68 is designed to mate with second fastening system 26. The second fastening system 68 preferably comprises a clasp with an adjustable strap, for example, although alternatively, the second fastening system 68 may comprise other fasteners, such as one side of a hook and loop fastener, a zipper, snap, or button, as examples.

A belt 52 is preferably attached to the back portion 50, for example, by stitching 62 on a superior pocket 16*c* and inferior pocket 16*d*. The belt 52 preferably comprises a superior lateral strap 54*a* and an inferior lateral strap 54*b*, as shown. Alternatively, the belt 52 may comprise a single strap, or three or more straps, (not shown). The straps 54*a*/54*b* preferably comprise elastic, and include a belt fastener 56 at either end. The belt fastener 56 preferably comprises a two-sided hook and loop fastener. For example, the loop side 58 may be disposed on the front side, in the hook side 60 may be disposed on the back side, or vice versa. The belt 52 is adapted to accommodate a variety of girths, with a variably adjusting diameter, provided by the optional belt fastener 22 disposed on the inferior pocket 16*b* on the front portion 14. The belt 52 may be fastened using the belt fastener 56, belt fastener 22, or both, for example.

Similar to the front portion 14, the back portion 50 preferably comprises an exterior material 78 that faces away from a wearer's body that may comprise a polymer fiber material such as nylon, for example. The back portion 50 also preferably comprises an inner liner material 76, also referred to herein as an inside liner, (not shown in FIG. 6) that may comprise an absorbent, moisture-wicking, anti-microbial, anti-bacterial material such as orthopedic beta material, although other materials may be used, such as cotton foam laminate, as an example. The exterior material 78 and inside liner 76 are stitched together to form the back portion 50.

The back portion 50 may also include padding 74 disposed between the inside liner 76 and exterior material 78 in the shoulder regions 64. The padding 74 may comprise cotton, polyester, or other materials, as examples. In one embodiment, the back portion 50 includes a support liner 84 disposed between the exterior material 78 and interior liner 76 proximate the at least one weight pocket 16. The support liner 84 preferably comprises polypropylene, and may alternatively comprise other materials, such as cotton or nylon, as examples. More preferably, the support liner comprises 1/16" polypropylene disposed only behind the pockets 16*c*/16*d*, for example. The support liner 84 is adapted to protect the wearer's body from injury, for example, during a fall taken while wearing the weight vest 10.

Either one or both of the front or back portion 14/50 may include an optional D-ring 82 preferably attached in a central region, for example, and more preferably disposed between the superior and inferior pockets 16*c*/16*d*, as shown. The D-ring 82 is preferably stitched to the back portion 50 using a short piece of strap material (not shown in FIG. 6), for example. The D-ring 82 may be used to clip to a rope or strap from the wearer to another person, for added resistance, over-speed training, and multiple plane resistance, as examples. Preferably, the D-ring strap is stitched to the back portion 50 in two or more places on the strap, to ensure that the D-ring 82 will not break free during a workout.

Figure 7:
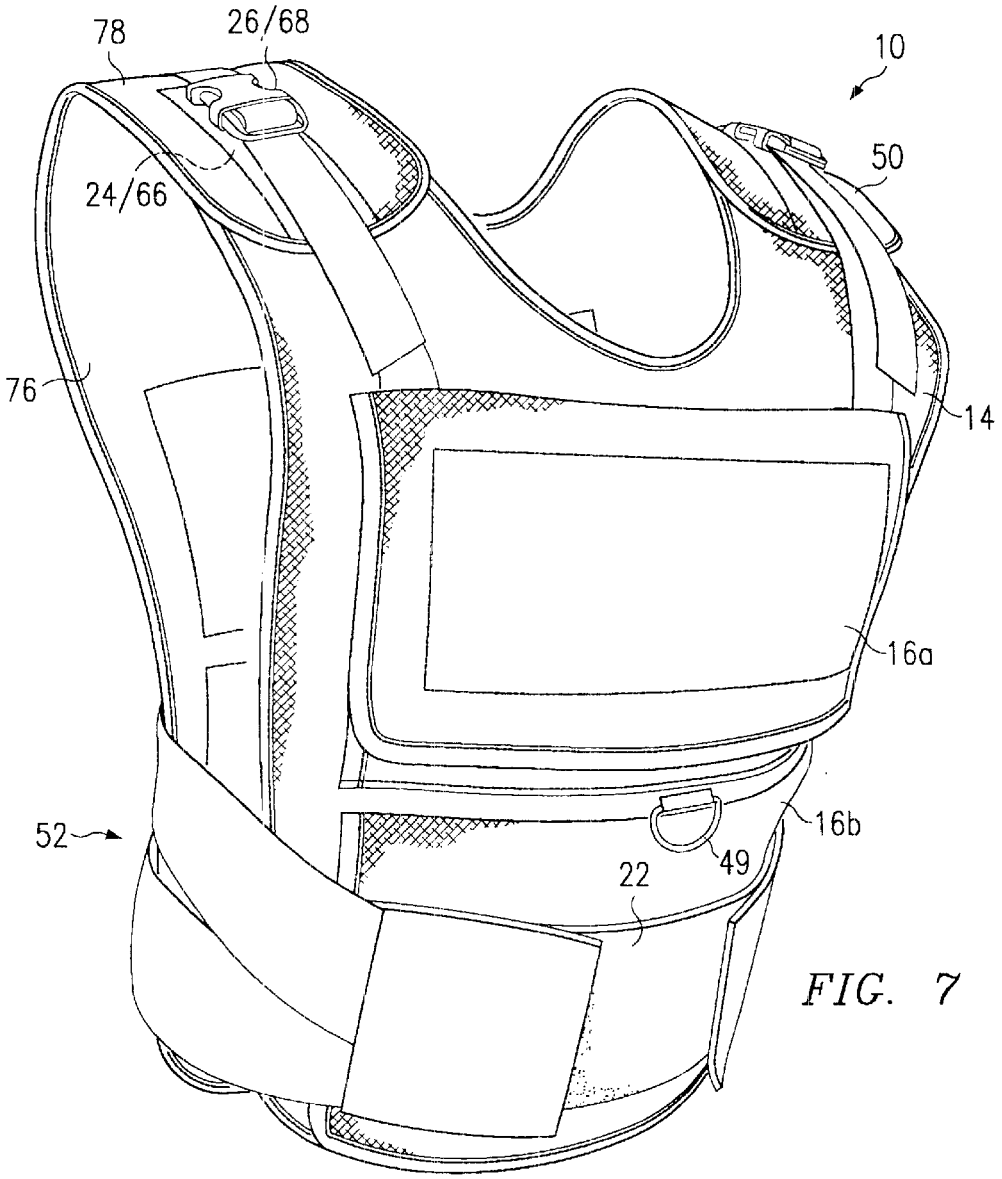
FIG. 7 illustrates a more detailed view of the assembled weight vest, adapted to accommodate a larger girth.

FIG. 7 shows the weight vest 10 with the front portion 14 attached to the back portion 50 by the first fastening system 24/66 and also by the second fastening system 26/68. The inside liner 76 faces towards a wearer's body and the external material 78 faces away from a wearer's body. As shown in FIG. 7, an optional belt fastener 22 attached to the inferior pocket 16*b* may be used to accommodate a person having a wide girth, for example. Belt fastener 22 may comprise a hook and loop fastener, and may alternatively comprise other fasteners adapted to connect to belt 52, for example.

Figure 8:
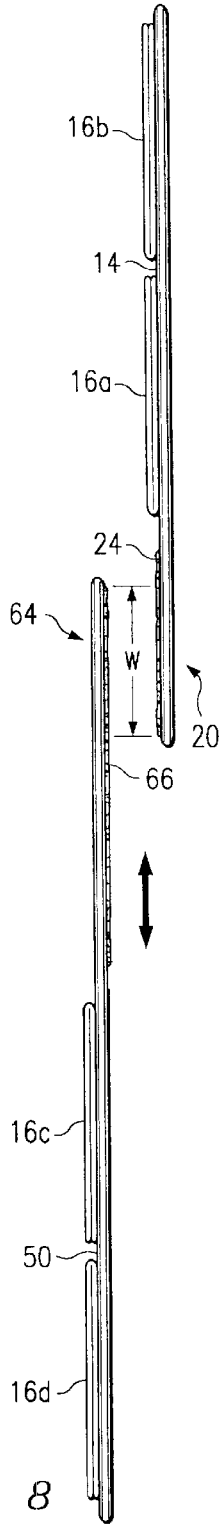
FIG. 8 shows a side view of the weight vest, wherein the front and back portion may be moved with respect to one another to accommodate various torso lengths.

FIG. 8 shows a side view of the front and back portions 14/50, illustrating the adjustable torso length provided by embodiments of the present weight vest invention. The shoulder regions 20/64 of the front and back portions 14/50 overlap so that the first fastening system 24/66 may make connection, for example, over distance w. The front and back portions 14/50 may be slid towards or away from one another prior to making connection of the first fastening system 24/66, in order to adjust the vest 10 to the length of the torso of the wearer.

Figure 9:
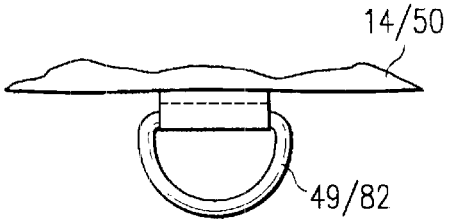
FIG. 9 shows a top view of the D-ring in accordance with an embodiment of the invention.

FIG. 9 shows a top view of the optional D-ring 49/82 in accordance with an embodiment of the present invention. Preferably the D-ring 49/82 is attached to either the front portion 14 or back portion 50 of the weight vest 10, and is adapted to extend at an approximately ninety degree angle from the front and back surfaces of the weight vest 10.

Preferably, the D-ring 49/82 is flexible to allow multi-plane resistance training and/or over-speed training, for example. A strap may be used to adhere the D-ring 49/82 to the vest 10, as shown and described herein.

Embodiments of the present invention provide several advantages. The weight vest 10 is securely held closely to the wearer's body by a belt 52 having two lateral straps 54*a*/54*b*. The vest 10 may be adjusted according to the length of the torso of the wearer by sliding the back portion 50 up or down along the shoulder region of the front portion 14, for example. A primary and secondary fastening system 24/66 and 26/68 are used to fasten the back portion 50 to the front portion 14. If one of these fastening systems 24/66 or 26/68 fails, there remains a back-up fastening system, which avoids the wearer injuring himself or someone else due to disassembly of the weight vest 10 during use.

The cylindrical weights 36 are tapered at the ends to lessen the chances of injury, and are placed vertically within the vest to avoid breaking or separating ribs, in case of a fall. The number of weights 36 may be varied according to the condition of the athlete and the application.

Padding 72/74 may be added to either the front portion 14 or back portion 50 shoulder regions, or both, in accordance with embodiments of the invention. Support liner 47/84 provides comfort and protects the wearer from injury due to the weights 36 being disposed on the torso of the wearer.

One embodiment of the invention includes a method of making a weight vest 10, comprising providing a front portion 14 and a back portion 50. The front portion 14 and back portion 50 each have two shoulder regions extending upwardly therefrom. A superior pocket 16*a* is sewn proximate the shoulder region 20, and an inferior pocket 16*b* is sewn below the superior pocket 16*a* on the front portion 14. Similarly, a superior pocket 16*c* is sewn proximate the shoulder region 64, and an inferior pocket 16*d* is sown below the superior pocket 16*c* on the back portion 50.

The method includes forming a plurality of sub-pockets 34 within the superior and inferior pockets 16*a*/16*b*/16*c*/16*d*, each sub-pocket 34 having a chamber 48 adapted to retain a single cylindrical weight 36. The front portion 14 is coupled to the back portion 50 by a first fastening system 24/66 at the shoulder region and also by a second fastening system 26/68 proximate the first fastening system 24/66. A belt 52 is coupled to the back portion. The belt 52 may have a superior lateral strap 54*a* and an inferior lateral strap 54*b*. The superior lateral strap 54*a* is coupled to the back portion superior pocket 16*c* and the inferior lateral strap 54*b* is coupled to the back portion inferior pocket 16*d*. The back portion 50 may have a longer shoulder region 64 than the front portion shoulder region 72. The weight vest 10 is adjustable to fit a wearer of the vest by moving the front and back portions 14/50 relative to one another.

Figure 10:
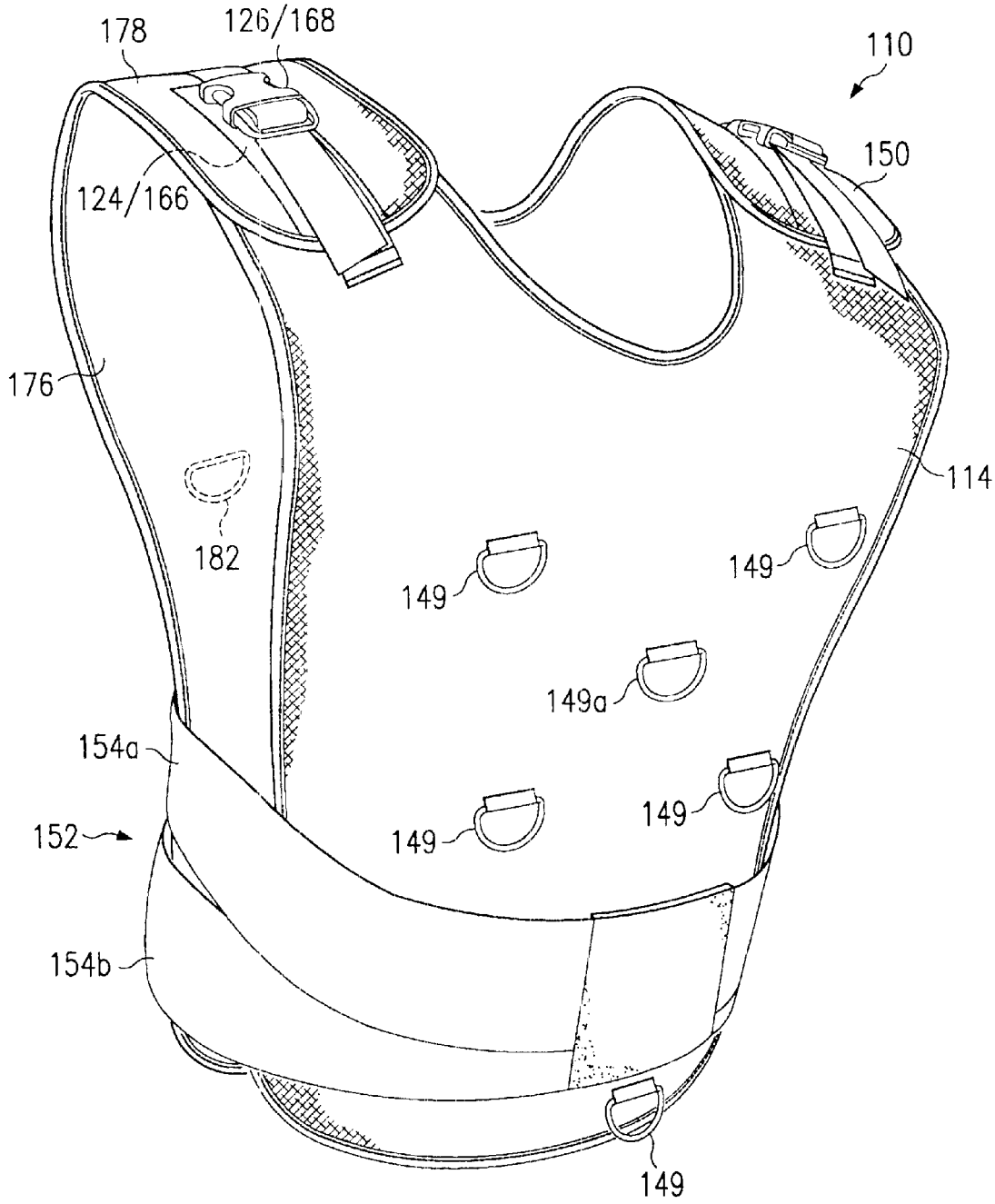
FIG. 10 illustrates another embodiment of an athletic training vest wherein at least one D-ring is attached to at least one of the front and back portions of the vest.

In an alternative embodiment of the present invention, rather than disposing weights within pockets of a vest, as described for other embodiments herein, the wearer's workout is increased by providing weight and resistance from another person or object, for example, by removeably attaching the vest in one or more regions to another person or object. This is accomplished by disposing a plurality of D-rings over the front and back portion of the vest. Shown in FIG. 10, an athletic training vest 110, comprises a first portion 114 having two shoulder regions extending upwardly therefrom, and a second portion 150 removeably attached to the first portion 114. The second portion 150 has two shoulder regions extending upwardly therefrom, and the first and second portions 114/150 are adjustably attached at the shoulder regions so that the length of the first and second portions 114/150 along a torso can be varied.

At least one D-ring 149/182 is coupled to at least one of the first and second portions 114/150, wherein the D-rings 149/182 may be used to attach to another person or object, for added resistance, over-speed training, and multiple plane resistance. For example, a rope or strap may be attached, e.g., clipped, to one or more of the D-rings 149/182, with the rope or strap being attached to another person or object, such as a slidable or floatable weight, as examples.

In one embodiment, a single D-ring 149*a* is preferably disposed in a central region of the first portion 114. Alternatively, a plurality of D-rings 149*a*/149 may be disposed on the first portion 114 so that the connection to another person may be varied, to change the direction of the resistance, or to connect to more than one other person or object. The plurality of D-rings 149/182 is preferably attached to the first portion 114 and the second portion 150 by a plurality of straps, wherein the straps are sewn to the first and second portions 114/150, preferably in using two or more seams.

A belt 152 is coupled to the second portion 150 adapted to extend around a wearer's torso and attach to the first portion 114, wherein the first and second portions 114/150 may be adjusted according to a wearer's torso length at the shoulder region. The athletic training vest 110 preferably comprises the same material 176/178 and similar first and second fastening systems 124/166 and 126/168 as described herein with reference to FIGS. 1 through 9, for example.

The athletic training vest 110 is advantageous in that a D-ring 149/182 may be coupled to another person or object in order to increase resistance during a workout, or provide multiple plane resistance. The vest 110 may be used over-speed training. A vest having a plurality of D-rings 140/182 provides a wide variety of options for increasing the resistance and directions thereof. The athletic training vest 110 is particularly advantageous for training in moving sports such as down-hill skiing, swimming, and running, as examples.

The weight vest 10 is described herein is particularly useful as an athletic training device for athletes. Applications in which embodiments of the present invention are particularly useful include downhill skiing training and conditioning, running, jogging, soccer, football, and plyometric training, as examples. Another application includes aquatic training, during which a treadmill is placed under water, and an athlete runs along the treadmill while submerged in the water. Wearing the weight vest 10 increases the difficulty of the workout and also assists the athlete in remaining under the water during the aquatic training. The weight vest 10 also has useful application for campers in preparing for back-packing trips, wherein the weight vest 10 may be worn during hiking to help prepare for long periods of time wearing a back-pack, for example. The weight vest 10 may also be used for combat and/or military training.

The weight vest 10 also has useful application as a rehabilitation device in a variety of medical applications, such as in the treatment of post-cerebral vascular accident (CVA) victims and persons suffering from multiple sclerosis (MS), for example, for lower extremity strength training and/or to improve one's balance. Furthermore, children having Autism or Down's syndrome have been found to be calmed and are able to focus for longer periods of time on a specific task when weights are placed on their upper bodies.

While the weight vest 10 has been described herein for use by humans, the weight vest 10 also has useful application for other two-legged animals, and also for four-legged animals. In particular, for example, the weight vest 10 may be sized to fit the torso of a dog. Dog trainers may place a weight vest 10 on a dog for strength and agility training, for example. The weight vest 10 may also be sized to fit the torso of a horse, and used to increase the stamina of a horse, for example, for horse racing. One or more additional belts may be utilized to hold the weight vest 10 securely against the animal's body.

Advantages of embodiments of the present invention include providing a weight vest 10 that is adjustable for a variety of torso lengths. The front portion 14 and back portion 50 are removably attached in the shoulder regions 20/64, and are fastened together by a primary 24/66 and secondary 26/68 fastening system, thus preventing the vest 10 from becoming disassembled during use. The weight vest 10 is securely held to the body by a quad lateral belt 52 having a superior lateral strap 54*a* and an inferior lateral strap 54*b*. Padding may be added in the front or back portions 14/50, or both, in the shoulder regions, to distribute the weight so that the vest 10 is comfortable for the wearer. Once fitted, the vest 10 is easy to adorn, by simply placing the head through the neck regions 46/80, wrapping the elastic belt 52 around the torso, and fastening the belt 52. The vest 10 has a sleek design and does not impede the wearer's movement during use. The vest 10 has a front and back portion 14/50, with open sides, providing ventilation and ease of movement of the arms. The weights 36 are not visible, but are contained within the pockets 16*a*/16*b*/16*c*/16*d*.

While the invention has been described with reference to illustrative embodiments, this description is not intended to be construed in a limiting sense. Various modifications in combinations of the illustrative embodiments, as well as other embodiments of the invention, will be apparent to persons skilled in the art upon reference to the description. In addition, the order of manufacturing steps may be rearranged by one of ordinary skill in the art, yet still be within the scope of the present invention. It is therefore intended that the appended claims encompass any such modifications or embodiments. Moreover, the scope of embodiments of the present application is not intended to be limited to the particular embodiments of the process, machine, manufacture, composition of matter, means, methods and steps described in the specification. Accordingly, the appended claims are intended to include within their scope such processes, machines, manufacture, compositions of matter, means, methods, or steps.

What is claimed is:

1. A weight vest, comprising:

a first portion having two shoulder regions extending upwardly therefrom;

a second portion removeably attached to the first portion, the second portion having two shoulder regions extending upwardly therefrom, the first and second portions being adjustably attached at each shoulder region so that the length of the first and second portions along a torso can be varied;

a first fastening system having means for coupling between each shoulder region of the first portion and each shoulder region of the second portion;

a second fastening system having means for coupling between each shoulder region of the first portion and each shoulder region of the second portion, the second fastening system being disposed proximate each first fastening system;

at least one first pocket disposed on the first portion, the first pocket having a volume sufficient to hold at least one weight, the at least one first pocket being disposed on an external surface of the first portion;

at least one second pocket disposed on the second portion, the second pocket having a volume sufficient to hold at least one weight, the at least one second pocket being disposed on an external surface of the second portion; and a belt coupled to the second portion, the belt being extendable around a wearer's torso to attach to the first portion, wherein the first and second portions can be adjusted according to a wearer's torso length at each shoulder region.

2. The weight vest according to claim 1, wherein the second portion shoulder regions are longer than the first portion shoulder regions.

3. The weight vest according to claim 1, wherein the first fastening system comprises a hook and loop closure, zipper, buckle, quick-release clasp, snap, or button; and wherein the second fastening system comprises a strap and clasp, zipper, buckle, quick-release clasp, snap, or hook and loop closure.

4. The weight vest according to claim 1, wherein the at least one first pocket comprises a superior pocket attached to the first portion proximate the shoulder region and an inferior pocket attached to the first portion disposed below the superior pocket the first portion superior and inferior pockets having a volume sufficient to hold a plurality of weights; and wherein the at least one second pocket comprises a superior pocket attached to the second portion proximate the shoulder region and an inferior pocket attached to the second portion disposed below the superior pocket, the second portion superior and inferior pockets having a volume sufficient to hold a plurality of weights.

5. The weight vest according to claim 4, further comprising a plurality of sub-pockets disposed within each first and second portion superior and inferior pocket, each sub-pocket including a vertical chamber having a volume sufficient to securely hold a cylindrical weight.

6. The weight vest according to claim 5, further comprising a cylindrical weight placed in at least one of the sub-pockets, wherein the weight has at least one tapered end.

7. The weight vest according to claim 5, wherein the weight is encapsulated in rubber and/or painted with a non-corrosive material.

8. The weight vest according to claim 5, wherein each weight weighs approximately one-half pound to two pounds.

9. The weight vest according to claim 5, wherein exactly ten sub-pockets are disposed within each front and second portion superior and inferior pocket.

10. The weight vest according to claim 4, wherein the first and second portion superior and inferior pockets include a closable flap.

11. The weight vest according to claim 10, wherein the comprising a pocket closing mechanism coupled to the first and second portion superior and inferior pocket closable flap.

12. The weight vest according to claim 11, wherein the pocket closing mechanism comprises a hook and loop closure, zipper, buckle, quick-release clasp, snap, or button.

13. The weight vest according to claim 10, wherein the pockets further include a pocket inner portion and a pocket front, wherein the closeable flap, pocket inner portion and pocket front are comprised of a single piece of a material.

14. The weight vest according to claim 10, wherein the closable flap extends substantially the entire length and width of the pocket front.

15. The weight vest according to claim 1, wherein the belt comprises a superior lateral strap and an inferior lateral strap disposed beneath the superior lateral strap, wherein the belt superior lateral strap is attached to the second portion superior pocket, and wherein the belt inferior lateral strap is attached to the second portion inferior pocket.

16. The weight vest according to claim 1, wherein the first portion comprises a front portion and the second portion comprises a back portion.

17. The weight vest according to claim 1, further comprising padding disposed within the shoulder region of at least one of the first and second portions.

18. The weight vest according to claim 1, further comprising at least one D-ring coupled to at least one of the first and second portions proximate the at least one first or second pocket.

19. The weight vest according to claim 1, wherein the first and second portion fit the torso of a two-legged or four-legged animal.

20. The weight vest according to claim 1, wherein the belt is fixedly attached to a central region of the second portion, and wherein the belt is removeably attachable to a central region of the first portion.

21. A weight vest, comprising:

a first portion having two shoulder regions extending upwardly therefrom;

a second portion removeably attached to the first portion, the second portion having two shoulder regions extending upwardly therefrom, the first and second portions being adjustably attached at the shoulder regions so that the length of the first and second portions alone a torso can at least one first pocket disposed on the first portion, the first rocket having a volume sufficient to hold at least one weight;

at least one second pocket disposed on the second portion, the second pocket having a volume sufficient to hold at least one weight; and a belt coupled to the second portion, the belt being extendable around a wearer's torso to attach to the first portion, wherein the first and second portions can be adjusted according to a wearer's torso length at the shoulder region, and wherein the first and second portions comprise an exterior liner including a polymeric fiber material and an interior liner including an absorbent, anti-microbial, anti-bacterial, moisture-wicking material.

22. The weight vest according to claim 21, further comprising a support liner disposed between the exterior liner and the interior liner of the first portion proximate the at least one first pocket, and a support liner disposed between the exterior liner and the interior liner of the second portion proximate the at least one second pocket.

23. The weight vest according to claim 22, wherein the support liners comprise polypropylene.

24. A weight vest, comprising:

a front portion having a first shoulder region and a second shoulder region, the first and second shoulder regions extending upwardly from the front portion;

a back portion removeably attached to the front portion, the back portion having a first shoulder region and a second shoulder region, the first and second shoulder regions extending upwardly from the back portion, the back portion first and second shoulder regions being longer than the front portion first and second shoulder regions, the front and back portions being attachable at the first and second shoulder regions;

a first fastening system having means for coupling between the first shoulder region of the front portion and the first shoulder region of the back portion, and a first fastening system having means for coupling between the second shoulder region of the front portion and the second shoulder region of the back portion;

a second fastening system disposed proximate each first fastening system, the second fastening system having means for coupling between the front and back portions;

a superior pocket attached to the front portion proximate the first and second shoulder regions, the superior pocket including a closeable flap;

an inferior pocket attached to the front portion disposed below the superior pocket, the inferior pocket including a closeable flap;

a superior pocket attached to the back portion proximate the first and second shoulder regions, the superior pocket including a closeable flap;

an inferior pocket attached to the back portion disposed below the superior pocket, the inferior pocket including a closeable flap;

a pocket closing device coupled to the front and back portion superior and inferior pocket closeable flaps;

a plurality of sub-pockets disposed within the front and back portion superior and inferior pockets, each sub-pocket including a vertical chamber having a volume sufficient to securely hold a cylindrical weight; and a belt coupled to the back portion, the belt being extendable around a wearer's torso to attach to the front portion by a belt fastener, the belt comprising a superior lateral strap and an inferior lateral strap disposed beneath the superior lateral strap, wherein the first and second portions can be adjusted according to a wearer's torso length at the first and second shoulder regions, wherein the belt holds the weight vest securely to a wearer's torso.

25. The weight vest according to claim 24, wherein the first fastening system comprises a hook and loop closure, wherein the second fastening system comprises a strap and clasp, wherein the pocket closing device comprises a hook and loop closure, and wherein the belt fastener comprises a hook and loop closure.

26. The weight vest according to claim 24, further comprising a cylindrical weight placed in at least one of the sub-pockets, wherein the weight weighs approximately one-half to two pounds and has tapered ends.

27. The weight vest according to claim 26, wherein the weights are encapsulated in rubber and/or are painted with a non-corrosive material.

28. The weight vest according to claim 24, wherein exactly ten sub-pockets are disposed within the front and back portion superior and inferior pockets.

29. The weight vest according to claim 24, further comprising padding disposed within the shoulder region of at least one of the front and back portions.

30. The weight vest according to claim 24, further comprising at least one D-ring coupled to at least one of the front and back portions proximate the front and back portion superior and inferior pockets.

31. The weight vest according to claim 24, wherein the front and back fit the torso of a two-legged or four-legged animal.

32. A weight vest, comprising:

a front portion having two shoulder regions extending upwardly therefrom;

a back portion removeably attached to the front portion, the back portion having two shoulder regions extending unwardly therefrom, the back portion shoulder regions being longer than the front portion shoulder regions, the front and back portions being attached at the shoulder regions;

a first fastening system coupled between the front and back portions between the shoulder regions;

a second fastening system disposed proximate the first fastening system, the second fastening system being coupleable to the front and back portions;

a superior pocket attached to the front portion proximate the shoulder regions, the superior pocket including a closeable flap;

an inferior pocket attached to the front portion disposed below the superior pocket, the inferior pocket including a closeable flap;

a superior pocket attached to the back portion proximate the shoulder regions, the superior pocket including a closeable flap;

an inferior pocket attached to the back portion disposed below the superior pocket, the inferior pocket including a closeable flap;

a pocket closing device coupled to the front and back portion superior and inferior pocket closeable flaps;

a plurality of sub-pockets disposed within the front and back portion superior and inferior pockets, each sub-pocket including a vertical chamber having a volume sufficient to securely hold a cylindrical weight; and a belt coupled to the back portion, the belt being extendable around a wearer's torso and attach to the front portion by a belt fastener, the belt comprising a superior lateral strap and an inferior lateral strap disposed beneath the superior lateral strap, wherein the first and second portions can be adjusted according to a wearer's torso length at the shoulder region, wherein the belt holds the weight vest securely to a wearer's torso, and wherein the front and back portions comprise an exterior liner including a polymeric fiber material and an interior liner including an absorbent, anti-microbial, anti-bacterial, moisture-wicking material.

33. The weight vest according to claim 32, further comprising a support liner disposed between the exterior liner and interior liner of the front and back portions, wherein the support liner is disposed proximate the front and back portion superior and inferior pockets.

34. The weight vest according to claim 33, wherein the support liners comprise polypropylene.

35. A method of making a weight vest, comprising:

providing a front portion and a back portion, the front portion and back portion each having two shoulder regions extending upwardly therefrom;

sewing a first superior pocket proximate the shoulder region and a first inferior pocket below the first superior pocket on the front portion;

sewing a first superior pocket proximate the shoulder region and a second inferior pocket below the second superior pocket on the back portion;

forming a plurality of sub-pockets within the first and second superior and inferior pockets, each sub-pocket having a chamber having a volume sufficient to retain a single cylindrical weight;

coupling each shoulder region of the front portion to one of the shoulder regions of the back portion by a first fastening system having means for coupling between the shoulder regions of the front portion and back portion coupling each shoulder region of the front portion to one of the shoulder regions of the back portion by a second fastening system proximate each first fastening system, the second fastening system having means for coupling between the shoulder regions of the front portion and the back portion; and coupling a belt to the back portion.

36. The method according to claim 35, wherein coupling a belt comprises coupling a belt having a superior lateral strap and an inferior lateral strap to the back portion, the superior lateral strap being coupled to the back portion superior pocket and the inferior lateral strap being coupled to the back portion inferior pocket.

37. The method according to claim 35, wherein the back portion has longer shoulder regions than the front portion shoulder regions.

38. The method according to claim 35, wherein the weight vest is adjustable to fit a wearer of the vest by moving the front and back portions relative to one another.

39. An athletic training vest, comprising:

a first portion having two shoulder regions extending upwardly therefrom;

a second portion removeably attached to the first portion, the second portion having two shoulder regions extending upwardly therefrom, the first and second portions being adjustably attached at the shoulder regions so that the length of the first and second portions along a torso can be varied;

a first fastening system having means for coupling between each shoulder region of the first portion and each shoulder region of the second portion;

a second fastening system having means for coupling between each shoulder region of the first portion and each shoulder region of the second portion, the second fastening system being disposed proximate each first fastening system;

at least one D-ring coupled to at least one of the first and second portions, wherein the D-ring can be used to attach to another person or an object for added resistance, over-speed training, and multiple plane resistance; and a belt coupled to a central exterior region of the second portion, the belt being extendable around a wearer's torso to attach to a central exterior region of the first portion, wherein the first and second portions can be adjusted according to a wearer's torso length at the shoulder region.

40. The athletic training vest according to claim 39, wherein a plurality of D-rings are attached to the first portion by a plurality of straps, wherein a plurality of D-rings are attached to the second portion by a plurality of straps, wherein the straps are sewn to the first and second portions.

* * * * *